US008454063B2

(12) United States Patent
David et al.

(10) Patent No.: US 8,454,063 B2
(45) Date of Patent: Jun. 4, 2013

(54) MODE-SWITCHABLE DOOR STRIKE

(75) Inventors: Dewey David, Glendale, AZ (US); Matthew Petersen, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 462 days.

(21) Appl. No.: 12/694,813

(22) Filed: Jan. 27, 2010

(65) Prior Publication Data

US 2011/0181059 A1 Jul. 28, 2011

(51) Int. Cl.
*E05B 15/02* (2006.01)
*E05B 15/00* (2006.01)

(52) U.S. Cl.
USPC ..... 292/341.16; 292/340; 292/341.15

(58) Field of Classification Search
USPC ..... 292/340, 341.15, 341.18, 341.16, 292/341.17
See application file for complete search history.

(56) References Cited

U.S. PATENT DOCUMENTS

| | | | | |
|---|---|---|---|---|
| 5,690,373 | A * | 11/1997 | Luker | 292/201 |
| 5,788,295 | A | 8/1998 | Fuss et al. | |
| 5,924,750 | A | 7/1999 | Fuss et al. | |
| 6,082,791 | A | 7/2000 | Frolov et al. | |
| 6,299,225 | B1 * | 10/2001 | Chang | 292/341.16 |
| 6,390,520 | B1 | 5/2002 | Holzer | |
| 6,516,569 | B2 * | 2/2003 | Schweitzer | 49/503 |
| 6,595,563 | B2 | 7/2003 | Kiernan | |
| 6,874,830 | B2 | 4/2005 | Bashford | |
| 7,021,684 | B2 * | 4/2006 | Orbeta et al. | 292/341.16 |
| 7,185,928 | B1 * | 3/2007 | Liao | 292/341.16 |
| 7,188,870 | B2 * | 3/2007 | Huang | 292/163 |
| 7,438,335 | B1 * | 10/2008 | Uyeda | 292/341.16 |
| 7,472,934 | B2 * | 1/2009 | Burke et al. | 292/341.16 |
| 7,503,599 | B2 * | 3/2009 | Ward | 292/341.16 |
| 7,540,542 | B2 * | 6/2009 | Geringer et al. | 292/341.16 |
| 8,047,585 | B1 * | 11/2011 | Peabody et al. | 292/341.16 |
| 2008/0006069 | A1 | 1/2008 | Liao | |

OTHER PUBLICATIONS

Robelin, Fabrice, "Partial European Search Report," for European application 11 000 679.8, filed Jan. 27, 2011, Dec. 20, 2012, The Hague.

* cited by examiner

*Primary Examiner* — Carlos Lugo
(74) *Attorney, Agent, or Firm* — Woods Oviatt Gilman LLP

(57) ABSTRACT

A lockable keeper arm extends across an opening of a door strike housing. A pivotally mounted transmission lever releasably engages the keeper arm. A pivotally mounted release lever releasably engages the transmission lever. An actuator engages the release lever at a point between the release lever pivot and the transmission lever and drives the release lever between alternate positions in either fail-safe and fail-secure modes. The actuator engagement point may be closer to the release lever pivot point than the transmission lever engagement point. A stop limits travel of the release lever and may be positioned in alternate positions. In alternate positions, the primary lever unlocks the keeper arm when the actuator is either energized or de-energized, placing the strike in fail-safe or fail-secure modes. Magnets may be mounted inside the housing to attract metal particles. The actuator may be an electric solenoid or a motor.

15 Claims, 8 Drawing Sheets

MODE-SWITCHABLE DOOR STRIKE

TECHNICAL FIELD

The present invention relates to mechanisms for electrically locking a door in a frame; more particularly, to such mechanisms wherein the electrical mechanism is switchable between fail-safe and fail-secure modes of operation; and most particularly, to a mode-switchable electric door strike wherein the mode is easily selectable by positioning of a stop at one of two alternate positions without requiring movement or repositioning of any other components of the strike.

BACKGROUND OF THE INVENTION

A distinction exists between modes of operation for electric door openers (referred to generally in the art as "electric strikes"), namely, fail-safe or fail-secure.

In fail-safe mode, the strike is unlocked at any time that an actuator, such as a solenoid or motor, is de-energized, thus permitting exit through the door in event of a power failure.

In fail-secure mode, the strike is locked at any time that the actuator is de-energized, thus securing the door against opening in event of a power failure.

In the older prior art, the two modes of operation have generally required two different basic constructions, resulting in increased costs for manufacture and stocking of the different constructions. Thus, it has been desirable in the art to develop strike mechanisms wherein a basic arrangement may be positioned in either fail-safe or fail-secure mode simply by reconfiguring certain internal strike elements. Unfortunately, such prior art reconfiguring typically requires significant movement of various operating elements, often further requiring the removal of the door strike assembly itself. Thus, the process can be cumbersome, difficult to complete reliably, and/or time-consuming to carry out. Further, at least one prior art device provides a means for changing the positions of internal elements from outside the housing. The ready-accessibility of the means can be undesirable for maintaining securing in a fail-secure mode.

U.S. Pat. No. 5,788,295, entitled "Electric Door Opener with Multiple Position Armature Permitting Different Operation Modes", discloses an electric door opener with a transmission lever ("trimmer" 6) pivotable about an axis 16 at a first end to lock and unlock a door latch 4. The transmission lever is actuable by a release lever ("armature" 8) pivotable about an axis 9 at a first end and having a shaped opening for receiving a head 17 of the transmission lever. A solenoid 13 includes a plunger 22 operable at the opposite end of the release lever. The release lever is adjustable by position to release or lock head 17 of the transmission lever. A rotation stop 10 is provided to switch the system between fail safe and fail secure modes by variably positioning the head 17 with respect to the opening.

The disclosed apparatus has at least two serious shortcomings.

First, the rotation stop to change fail-safe to fail-secure and vice versa, provided in the form of a turnable plug, can be readily tampered with using a simple tool.

Second, the contact point of the plunger to the release lever is at the distal end of the release lever from pivot axis 9, which requires a maximum stroke range of the solenoid plunger over which the internal air gap between the armature of the plunger and the core of the coil, and thus the pulling or holding force of the solenoid, necessarily varies substantially. Thus over some portion of the required range, the force of the solenoid available to hold the latch locked is relatively weak. Further, in a case where the actuating force is provided by a motor and the contact point of the motor's plunger or linkage is at the distal end of the release lever, the operating stroke of the motor needed to move the lever through its full range is maximized. What is needed is an arrangement wherein the required overall stroke of the actuating solenoid is shortened, thereby minimizing variation in air gap and solenoid strength. In the case of a motor actuated mechanism, what is needed is an arrangement wherein the operating stroke of the motor is minimized.

U.S. Pat. No. 6,390,520 B1, entitled "Door Opener", the relevant disclosure of which is herein incorporated by reference, discloses an electric door opening mechanism which is operable in either a fail safe or fail secure mode according to whether electric power is connected or disconnected to a pair of coils acting upon lever-shaped rotatable armatures external to the coil. The disclosure includes provisions for adjustment of internal stops to the rotatable armatures and provisions for changing coil positions relative to the armatures.

A shortcoming of this apparatus is that, when changing between fail-safe and fail-secure modes, to properly position the coil and to establish the correct range of rotational stroke of the armature, two elements must be repositioned in two separate operations. The coil must be repositioned relative to the rotational armature and the fixed stop must be removed, inverted, and re-installed.

In addition, through the normal operation and usage of a strike and latch mechanism, metal particles abraded from mating metal surfaces, such as from the latch bolt and strike, may collect inside the strike housing and may cause binding of close-fitting components within the housing. For example, a solenoid plunger's movement can become sluggish or stuck from metal debris entering between the plunger and solenoid body or a motor's movement may become sluggish or stuck if debris enters the motor mechanism.

None of the known prior art discloses the improved device which remedies these shortcomings set forth herein.

What is needed in the art is an electric door strike wherein the mechanism may be changed easily between fail-safe and fail-secure modes; wherein the means for changing is not accessible without at least removal of an outer cover plate; wherein no repositioning of an actuator, such as a coil, solenoid or motor, is required to change between operating modes, and wherein binding of closed fitting moving components within the housing, such as a solenoid plunger or motor mechanism, is reduced.

It is a principal object of the present invention to simplify, without compromising security, the switching of an electric strike between fail-safe mode and fail-secure mode.

SUMMARY OF THE INVENTION

Briefly described, an electric door opening mechanism in accordance with the present invention comprises a housing having a central cutout portion with an opening adapted to receive a bolt of a door. First and second keeper arms are pivotably mounted on opposite first and second sides of the opening and have latch elements extending across the opening, and have a first position occluding the opening, which position may be locked or unlocked, and a second position pivotable from the first position which allows the bolt to be withdrawn from the opening past the latch elements. First and second transmission levers pivotally mounted to the housing releasably engage the first and second keeper arms. First and second release levers pivotably mounted to the housing releasably engage the first and second transmission levers, respectively. In one aspect of the invention, first and second solenoid plungers engage the first and second release levers, respectively, at a point close to the rotational axes of the release levers, and drive them between alternate positions in each of the fail-safe and fail-secure modes. Motors may also be used to drive the release levers through contact points close to the rotational axes of the release levers. Stops selectively positioned in the housing limit the actuation range of the release levers. The stops may be positioned in either of alternate positions. In one of such stop positions, the rotational range of the release levers is limited such that the overall linkages serve to unlock the keeper arms when the actuators are de-energized, thus placing the strike in fail-safe mode. In the other of such stop positions, the rotational range of the release levers is limited such that the overall linkages serve to lock the keeper arms when the solenoids are de-energized, thus placing the strike in fail-secure mode. Preferably, the stops are movable from within the housing only after removing a housing cover.

Preferably, one or more permanent magnets are included within the housing to collect metal particles generated by wear of the latch over the lifetime of the assembly.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1B:
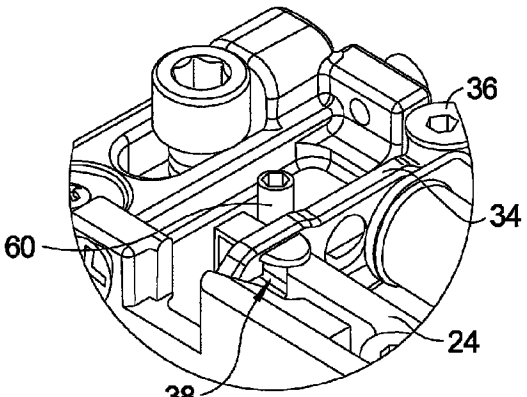
FIG. 1B is a detailed view of the area shown in circle 1B in FIG. 1.
Figure 1:
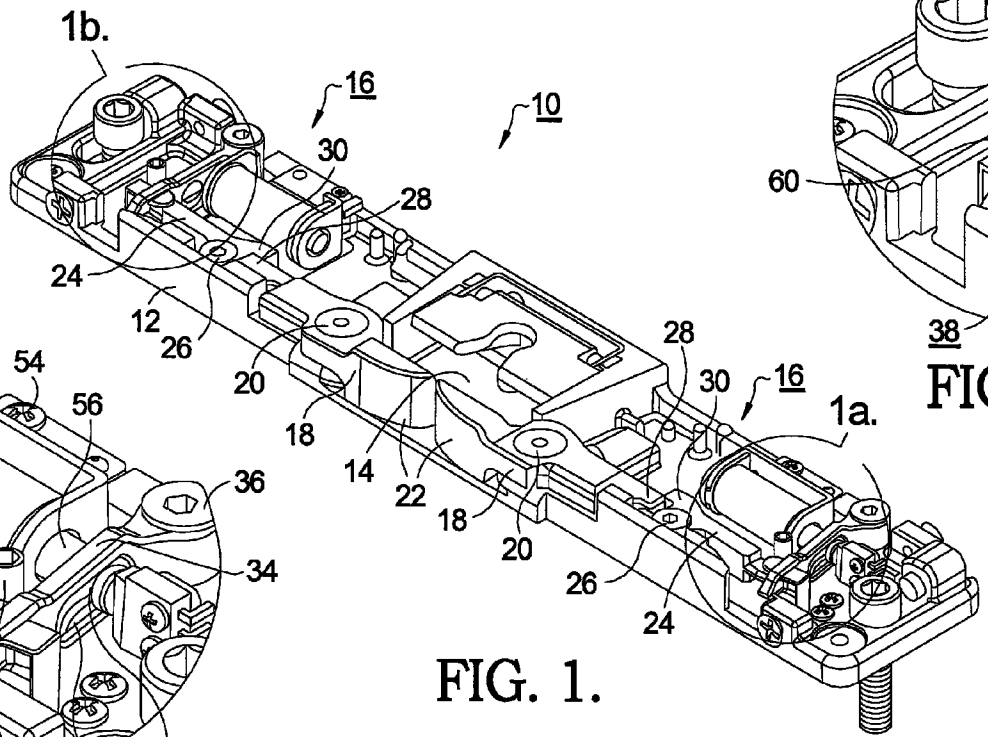
FIG. 1 is an isometric view from the right front showing a first embodiment of the present invention with the cover removed for clarity (cover is removed and not shown in all views herein)

Referring now to FIGS. 1 through 4, a first embodiment 10 of a mode-switchable electric door strike in accordance with the present invention comprises a housing 12 mountable to a door jamb (not shown). Such mounting may be either surface mounting or recessed mounting, as is well known in the prior art. A cover (not shown) protects the interior of housing 12 from tampering as well as from dirt, dust, and the like. Housing 12 includes a cutout portion 14 adapted to receive a bolt (not shown) of a door (not shown) as is also known in the prior art.

A mode-switchable electric door strike in accordance with the present invention preferably comprises first and second mirror-image locking mechanisms 16 mounted to housing 12 and disposed symmetrically about cutout portion 14 as shown in the following disclosure and discussion. For simplicity and clarity in presentation, general reference may be made to only one of the two mirror-image mechanisms 16, but such reference should be considered as being equally applicable to both except as may be noted. The use of a pair of keeper arms 18 is presently preferred over a single keeper arm as each keeper arm of the pair is subject to only half of any incoming force which, in turn, means that the strength of the device is essentially doubled. However, it should be noted that, while the drawings depict a strike with first and second mirror-image locking mechanisms, the invention contemplates use of a single keeper arm 18 and locking mechanism 16 if desired.

Opposing keeper arms 18 are mounted at keeper arm pivots 20 positioned proximate the midpoint of keeper arms 18 and are positioned proximate to cutout portion 14. When keeper arms 18 are oriented in a closed position, latch portions 22 of arms 18 extend into and occlude cutout portion 14 thereby retaining the door bolt within cutout portion 14. As is known in the prior art, when the door is moved closed, the door bolt is free to be received by cutout portion 14, even when keeper arms 18 are in closed positions. That is, when the door is shut into a frame supporting strike 10, the door bolt moves to allow passage past latch portions 22 but then snaps into cutout portion 14. Once in cutout portion 14 and when keeper arms 18 are in closed positions, the bolt is trapped in cutout portion 14 and the door cannot be opened. Such keeper and strike action are well known in the art and the operation thereof will not be further discussed herein.

Keeper arms 18 are adapted to engage with transmission levers 24 mounted to housing 12 by transmission lever pivots 26. The axes of rotation of transmission lever pivots 26 are parallel to and aligned vertically with the axes of keeper arm pivots 20.

Prong 28 is positioned on each keeper arm 18 opposite latch portion 22. Prong 28 is received within a fork 30 positioned on a corresponding side of transmission lever 24 when keeper arm 18 is in a closed position.

Keeper arms 18 are resiliently urged to the closed position by springs (not visible) which may be mounted on pivots 20. One arm of each spring engages a keeper arm 18 on its prong side and the other arm engages a sidewall of cutout portion 14. Thus, when prongs 28 are released from forks 30, keeper arms 18 are held in the closed position only by the springs. To open the door, a user simply pushes against the door, causing the bolt to rotate keeper arms 18 against the springs. Once the bolt clears keeper arms 18, the keeper arms rotate back to the closed position under the urging of the springs. Further, to best position each transmission lever 24 to receive prong 28, a compression spring (not shown) may be mounted on one end thereof to fork 30 (in recess 32, FIGS. 4A-4C) and at the other end thereof to housing 12 proximate fork 30. The compression springs urge transmission levers 24 rotatably away from housing 12 to best position fork 30 to receive prong 28.

A release lever 34 is used to control the motion of each transmission lever 24 from a rotatable state to a locked state. Release lever 34 is mounted at one end thereof to housing 12 by release lever pivot 36. The axes of rotation of release lever pivots 36 are parallel to but offset laterally from the axes of both keeper arm pivots 20 and transmission lever pivots 26. The other ends of release levers 34 engage ends 38 of transmission levers 24 opposite forks 30.

Figure 4C:
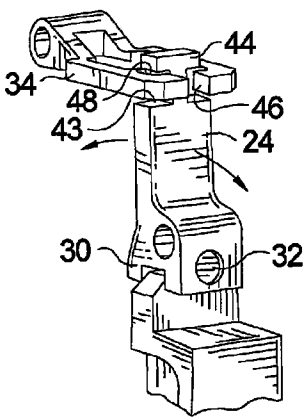
FIG. 4C is an isometric view of the release and transmission levers in an unlocked position in fail-secure mode.
Figure 4B:
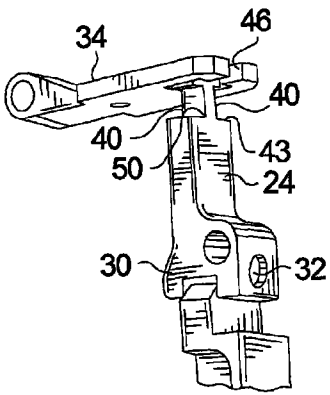
FIG. 4B is an isometric view of the release and transmission levers in a locked position.
Figure 4A:
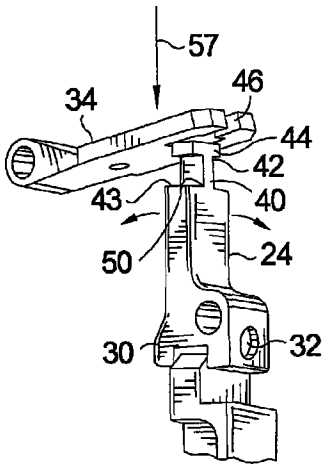
FIG. 4A is an isometric view of the release and transmission levers in an unlocked position in fail-safe mode.

As best seen in FIGS. 4A, 4B, and 4C, the end of transmission lever 24 opposite fork 30 is provided with a pair of opposing laterally extending rectangular channels 40 which cut across transmission lever 24. Sidewalls 42 of channels 40 in combination with the bottoms 43 of channels 40 form a T-shaped key 44. A corresponding T-shaped opening 46 is provided in release lever 34. A base 48 of T-shaped opening 46 is sized to allow a base 50 of key 44 to move freely therethrough.

The embodiment described provides three positions for release lever 34 with respect to transmission lever 24.

In the first position (unlocked fail-safe) seen in FIG. 4A, release lever 34 is completely disengaged from transmission lever 24, whereby transmission lever 24 is allowed to rotate freely to the unlocked position as described above.

In the second position (locked in fail-safe and fail-secure modes) seen in FIG. 4B, the arms of key 44 are positioned within the arms of opening 46. In this position, key arms 44 cannot move out via opening 46, whereby rotation of transmission lever 24 is prevented. With transmission lever 24 thus locked in place, keeper arms 18 are held in the locked position and the door cannot be opened.

In the third position (unlocked fail-secure) seen in FIG. 4C, release lever 34 is positioned whereby the base 50 (FIG. 4A) of T-shaped key 44 is positioned within the arms of T-shaped opening 46. Since key base 50 can freely move through opening 46, transmission lever 24 can freely rotate to an unlocked position thereby allowing the door to be opened as desired.

Referring again to FIGS. 1-4, to control the movement of release lever 34, a solenoid 52 is mounted proximate thereto on housing 12 by mounting screw 54 engaging a correspondingly threaded hole. Solenoid plunger 56 extends through an opening 58 in release lever 34 adjacent release lever pivot 36 and is retained therein by annular groove 59 formed in plunger 56. Thus, whenever, solenoid 52 is energized, release lever 34 is drawn thereto, in the direction shown by arrow 57 in FIG. 4A. A reverse force is provided by a spring (not visible) preferably within solenoid 52 which resiliently urges release lever 34 away from solenoid 52.

Note that in the present invention, solenoid plunger 56 engages release lever 34 at a point between T-shaped opening 46 and pivot 36, close to the pivot, whereas in U.S. Pat. No. 5,788,295, as described above the solenoid plunger engages the release is lever well distal of the lever's pivot. That is, the opening for receiving the transmission (trimmer) lever is placed between the engagement point of the plunger and the release lever pivot, making the engagement point necessarily remote from the pivot and thus engendering an undesirable range of stroke of the solenoid armature.

Moreover, in accordance with the present invention, the fail-safe and fail-secure modes of strike operation are regulated simply by repositioning a singular lever stop. The solenoid does not have to be repositioned as the coil had to be in U.S. Pat. No. 6,390,520.

Figure 1A:
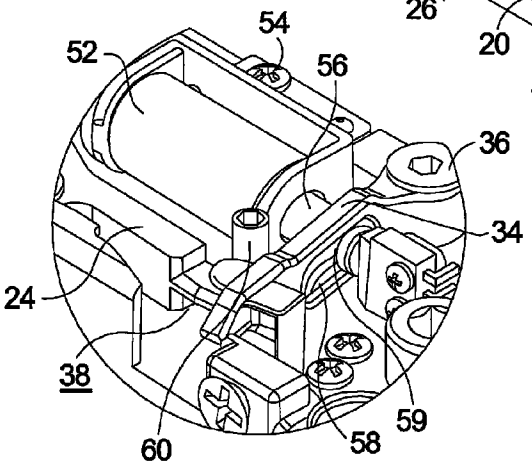
FIG. 1A is a detailed view of the area shown in circle 1A in FIG. 1.
Figure 2:
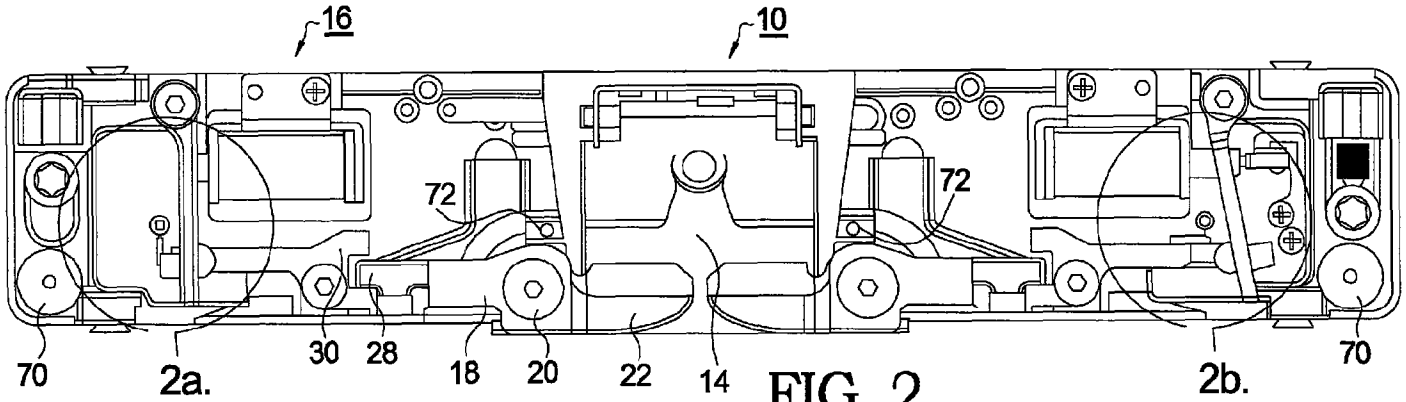
FIG. 2 is a plan view of the first embodiment shown in FIG. 1.
Figure 2B:
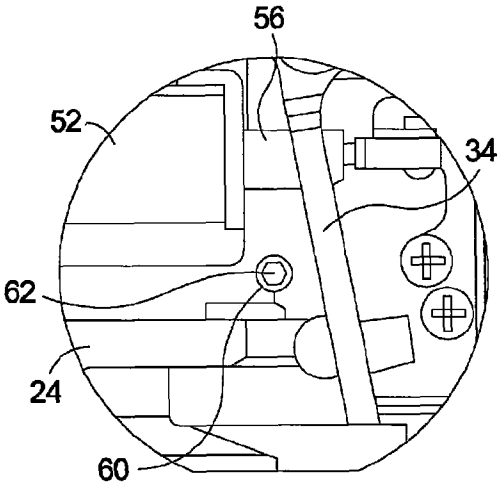
FIG. 2B is a detailed view of the area shown in circle 2B in FIG. 2.
Figures 3, 3A, 3B:
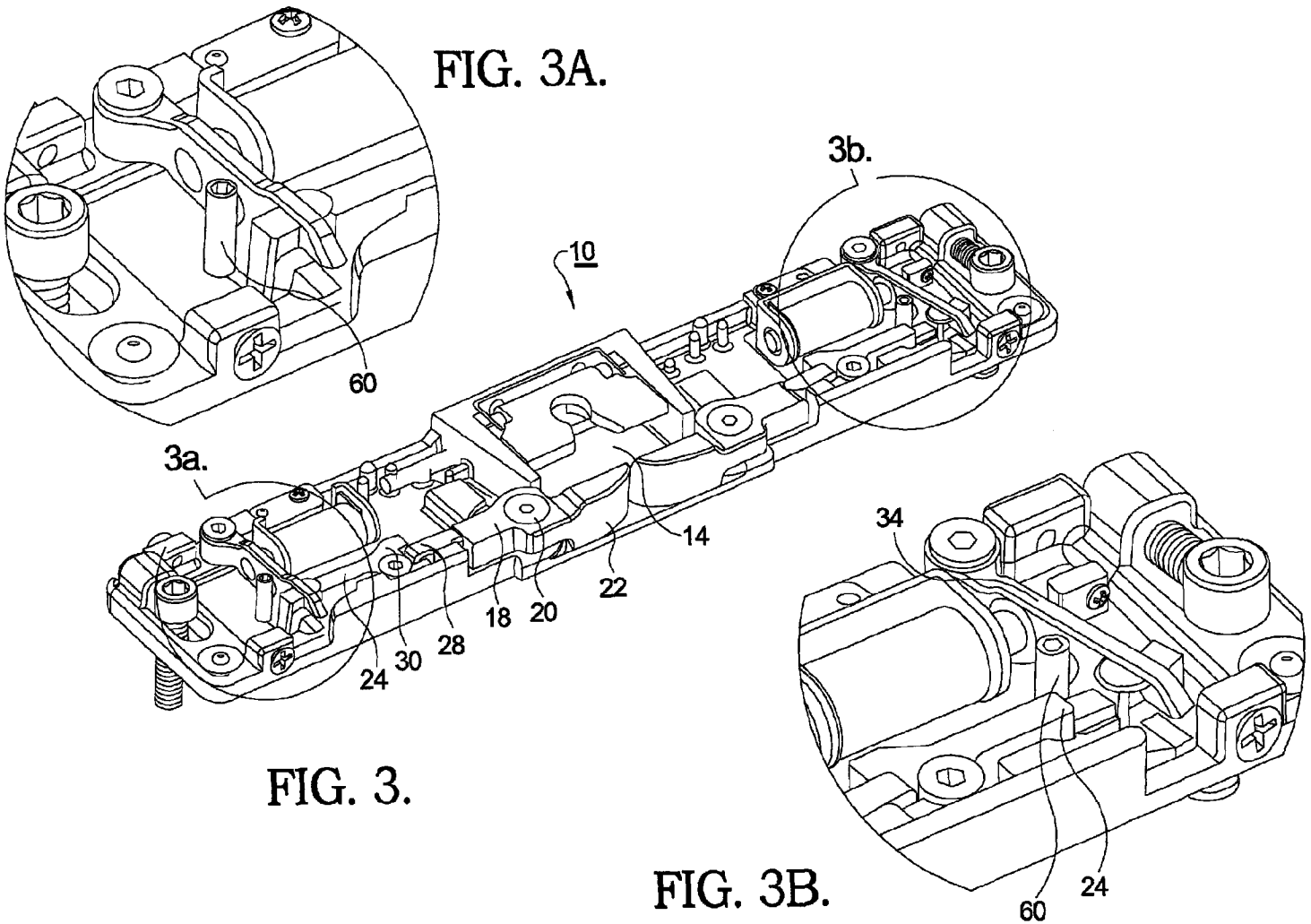
FIG. 3 is an isometric view from the left front of the first embodiment shown in FIG. 1.
FIG. 3A is a detailed view of the area shown in circle 3A in FIG. 3.
FIG. 3B is a detailed view of the area shown in circle 3B in FIG. 3.
Figure 9A:
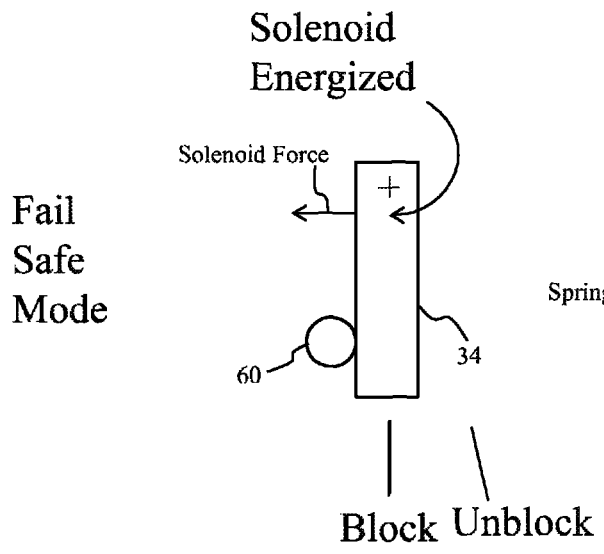
FIG. 9A is a schematic drawing of a portion of the first embodiment showing the release lever in a locked fail-safe position when the solenoid is energized.
Figure 9B:
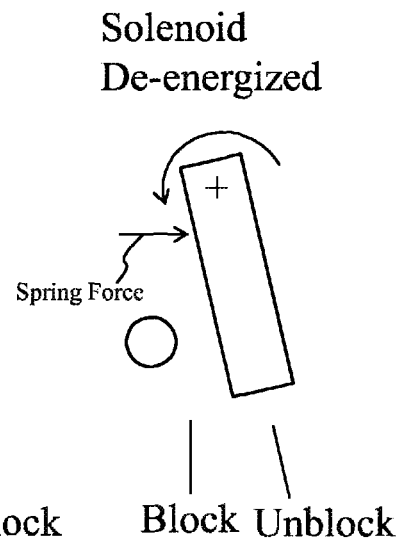
FIG. 9B is a schematic drawing of a portion of the first embodiment showing the release lever in an unlocked fail-safe position when the solenoid is de-energized.

To provide the fail-safe position shown in FIG. 4A, a stop 60, in the form of a post, is mounted on housing 12 as shown in FIGS. 1A, 2B, and 3B on the solenoid-facing side of release lever 34. When solenoid 52 is de-energized, the solenoid spring urges release lever 34 away from stop 60 and to the unlocked fail-safe position shown in FIGS. 4A and 9B. In the fail-safe mode, upon energizing of solenoid 52, stop 60 limits the solenoid inward stroke and corresponding motion of release lever 34 to the locked position shown in FIGS. 4B and 9A. Thus in fail-safe mode, the stroke of plunger 56 and rotation of release lever 34 are limited between positions 4A (solenoid de-energized) and 4B (solenoid energized).

Figure 2A:
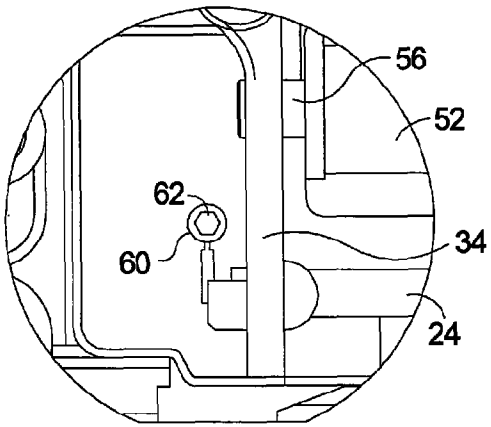
FIG. 2A is a detailed view of the area shown in circle 2A in FIG. 2.
Figure 8A:
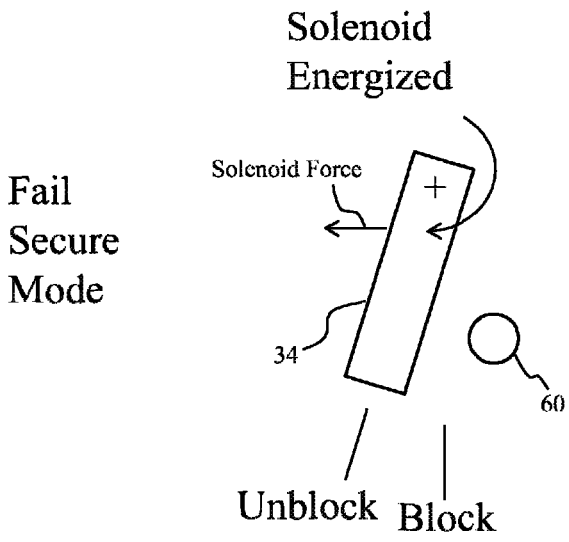
FIG. 8A is a schematic drawing of a portion of the first embodiment showing the release lever in an unlocked fail-secure position when the solenoid is energized.
Figure 8B:
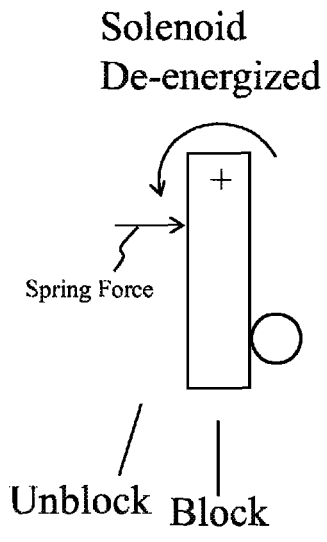
FIG. 8B is a schematic drawing of a portion of the first embodiment showing the release lever in a locked fail-secure position when the solenoid is de-energized.

To provide a fail-secure position of release lever 34, stop 60 is moved to a second location on the opposite side of release lever 34 as shown in FIGS. 1B, 2A, and 3A. In this stop location, the outward de-energized stroke of plunger 56 and rotation of release lever 34 are limited by stop 60 to the locked position shown in FIG. 4B. When solenoid 52 is energized, plunger 56 pulls release lever 34 away from stop 60 and into the third position shown in FIGS. 4C and 8A, thereby permitting transmission lever 24 to rotate and to allow keeper arm 18 to release the door bolt from cutout portion 14. This is the fail-secure mode whereby when the power is off, release lever 34 returns to rest against stop 60 and into a position as shown in FIGS. 4B and 8B, thereby locking transmission lever 24 and keeping the door from being opened.

Stop 60 may take any one of several forms. In first embodiment 10, stop 60 is preferably a post 62, such as a shoulder screw, secured to housing 12 from within the strike cover accessible only by removing the housing cover, or from the rear of housing 12 (not shown) after first removing the entire strike housing from its mount. In either case, a mode change can be made by simply repositioning a stop. Note that a mode change cannot be made without at least removing the housing cover thereby substantially reducing the tamperability of the mode switching feature.

Figure 5:
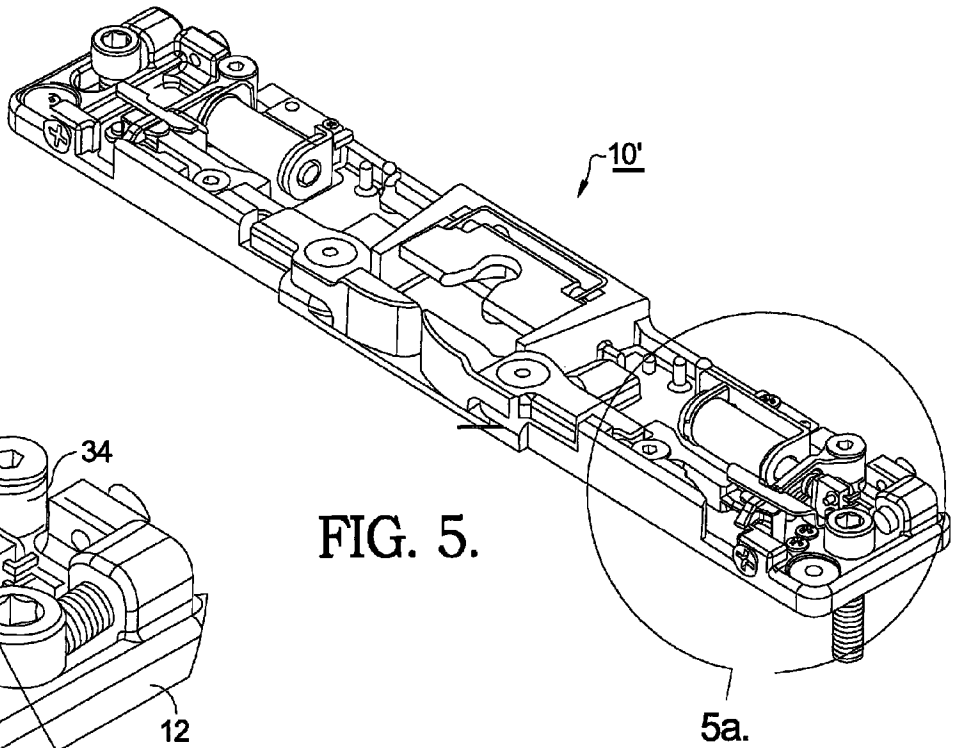
FIG. 5 is an isometric view from the right front showing a second embodiment of the present invention.
Figure 5A:
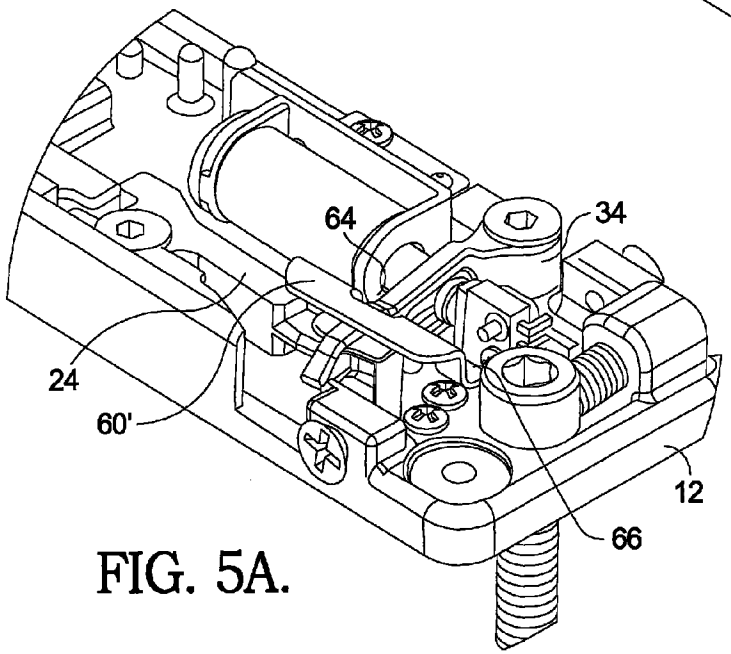
FIG. 5A is a detailed view of the area shown in circle 5A in FIG. 5.
Figure 6B:
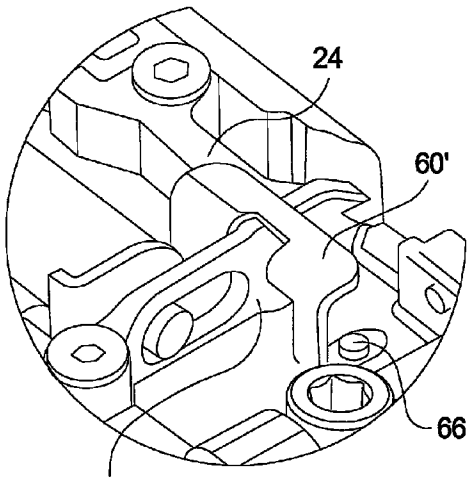
FIG. 6B is a detailed view of the area shown in circle 6B in FIG. 6.
Figure 6:
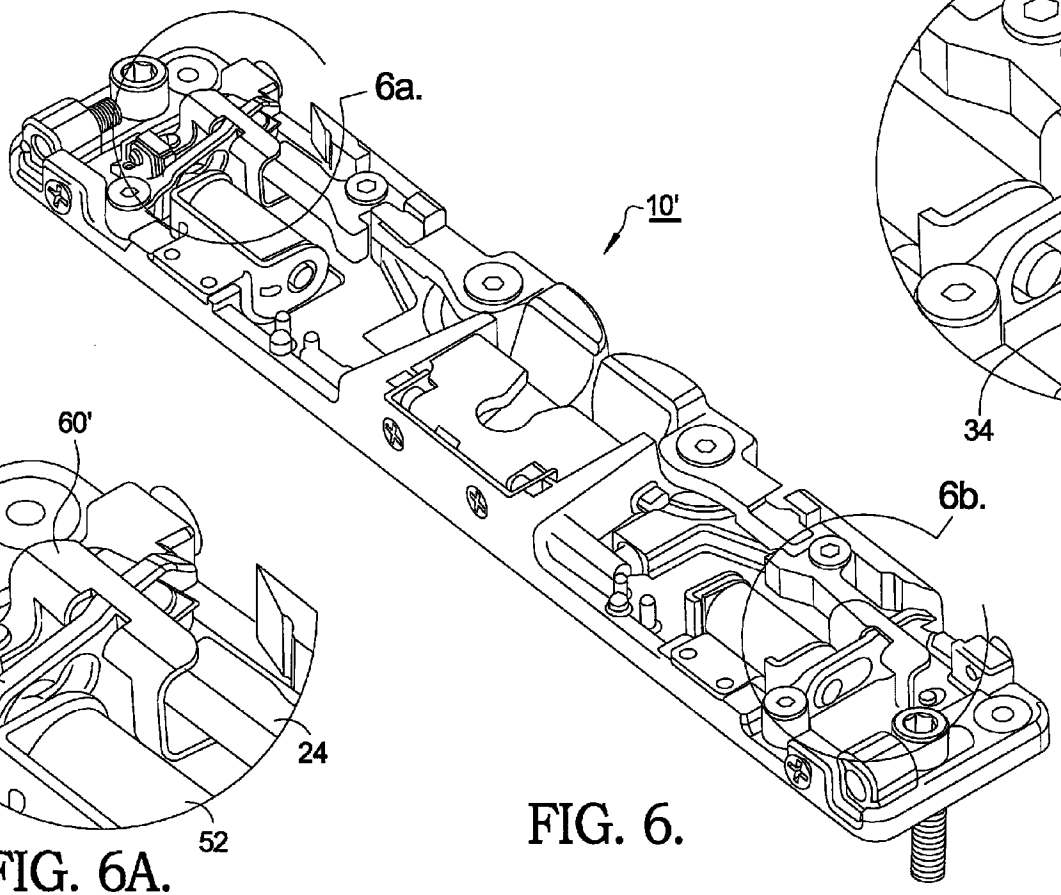
FIG. 6 is an isometric view from the right rear of the second embodiment shown in FIG. 5.
Figure 6A:
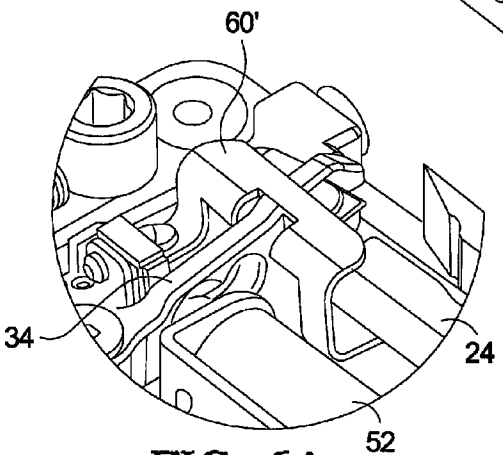
FIG. 6A is a detailed view of the area shown in circle 6A in FIG. 6.
Figure 7:
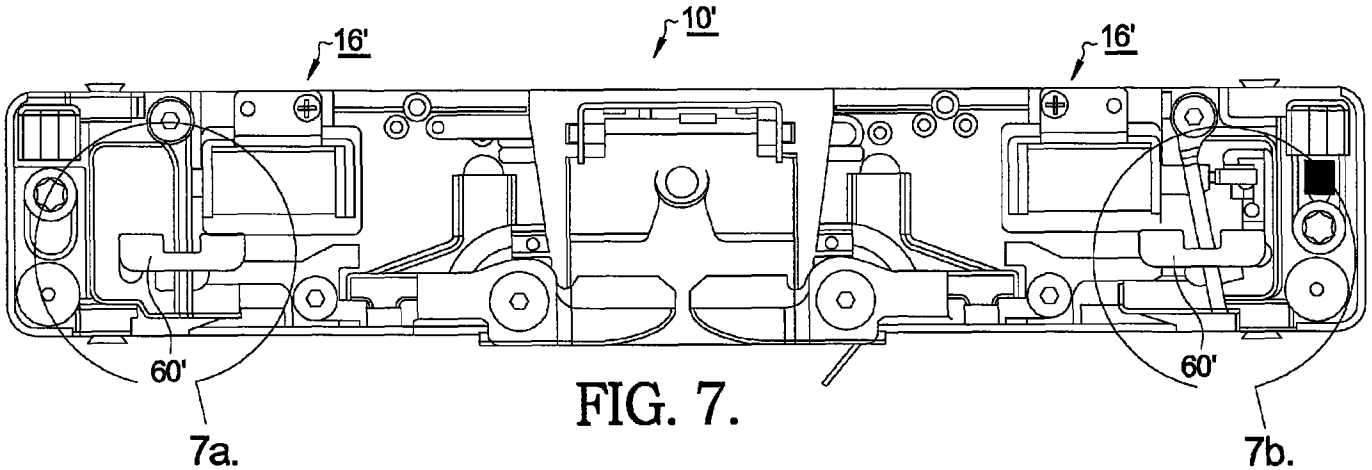
FIG. 7 is a plan view of the second embodiment shown in FIG. 5.
Figure 7B:
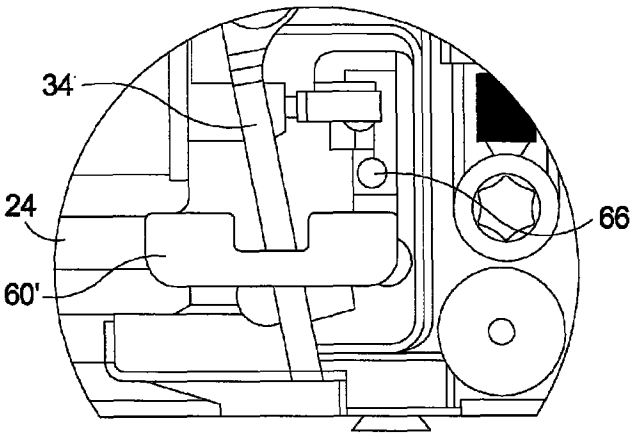
FIG. 7B is a detailed view of the area shown in circle 7B in FIG. 7.
Figure 7A:
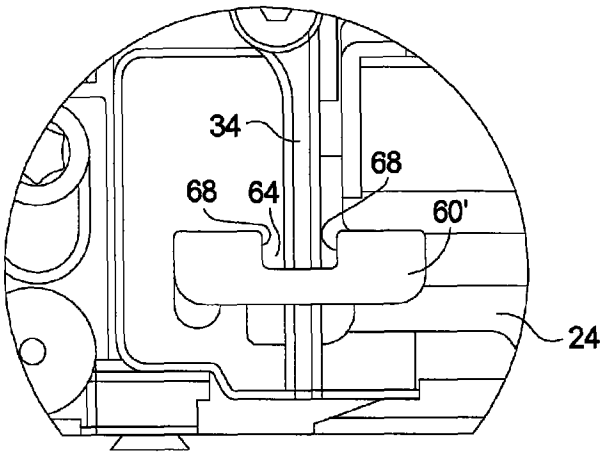
FIG. 7A is a detailed view of the area shown in circle 7A in FIG. 7.

Referring now to FIGS. 5-7, in a second embodiment 10' wherein all elements are identical with those of first embodiment 10 except a stop 60' is formed as an inverted U-shaped bracket having a central opening or gate 64. Stop 60' may be secured by one or more screws 66 that are accessible from either within the housing or from the rear of housing 12. The width of gate 64 is selected such that a side 68 of the gate limits motion of release lever 34 when the solenoid is energized (position 4B—fail-safe mode) when stop 60' is mounted at a first location as shown in FIG. 7A, and a side 68 of the gate limits motion of release lever 34 when the solenoid is de-energized (position 4B—fail-secure mode) when stop 60' is mounted at a second location as shown in FIG. 7B.

(Note: In FIGS. 1 through 3 and 5 though 7, for illustrative purposes only, stops 60, 60' are shown in both fail-safe and fail-secure modes in opposite locking mechanisms 16, 16' within a single device.

Other stop configurations are fully anticipated by the present invention. For example, a U-shaped element (not shown) having legs the same distance apart as gate sides 68 of stop 60' may be inserted through appropriately-spaced holes 9 (not shown) in the base of housing 12.

Referring now to FIG. 2, a known problem in use of electric strikes is that latch components such as portions 22 undergo significant wear from being abraded by the latch bolt during the working life of a strike, which can produce metal particles that migrate and undesirably cause binding of moving components within the strike such as, for example, the solenoid plunger. Such particles typically are ferromagnetic and therefore can be attracted to magnets. To quarantine such particles, first and second large button magnets 70 and small button magnets 72 are mounted to the housing exemplarily as shown in FIG. 2. Obviously, other locations may be used.

While the invention has been described herein utilizing solenoids to drive the release levers through their alternate positions, it is understood that motors may be used to drive the release levers, through linkages or direct, and wherein the motors may be any type, such as for example, electric, vacuum, pneumatic or hydraulic and may act linearly or rotationally to drive the levers.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A mode-switchable door strike switchable between a fail-safe mode and a fail-secure mode, comprising:

a) a housing having an opening for admission and retraction of a door bolt;

b) a keeper arm movably attached to said housing, and movable between a closed position wherein said opening is occluded and an open position wherein said door bolt may be released from said opening;

c) a transmission lever pivotably attached to said housing for selectively engaging said keeper arm and being rotatable to selectively lock and unlock said keeper arm in said closed position;

d) an actuator connected to said housing;

e) a release lever rotatably attached to said housing at a first point and engaged with said transmission lever at a second point to selectively lock and unlock said transmission lever by rotation of said release lever by said actuator; and f) a stop alternatively mountable in one of at least two positions adjacent said release lever, wherein a first position of said stop limits rotation of said release lever in a first rotational direction when said actuator is de-energized, and wherein a second position of said stop limits rotation of said release lever to a second rotational direction opposite said first rotational direction when said actuator is energized, therefore allowing the door strike to switch between said fail-safe mode and said fail secure mode.

2. A mode-switchable door strike in accordance with claim 1 wherein said keeper arm, said transmission lever, said release lever, said actuator, and said stop define a first locking mechanism disposed at a first side of said housing opening, and wherein a second locking mechanism is disposed across said housing opening at a second side thereof.

3. A mode-switchable door strike in accordance with claim 1 wherein said movable stop is a post.

4. A mode-switchable door strike in accordance with claim 1 wherein said movable stop is an inverted U-shaped element having a central gate receivable of said release lever.

5. A mode-switchable door strike in accordance with claim 4 wherein the width of said central gate is selected such that a side of said gate limits motion of said release lever when said element is mounted in said first or second positions.

6. A mode-switchable door strike in accordance with claim 1 further comprising at least one magnet mounted to said housing for attracting ferromagnetic particles.

7. A mode-switchable door strike in accordance with claim 1 wherein said actuator is an electric solenoid and a plunger of said electric solenoid is operationally in contact with said release lever at said third point.

8. A mode-switchable door strike in accordance with claim 1 wherein said actuator is a motor operationally in contact with said release lever at said third point.

9. A mode-switchable door strike in accordance with claim 8 wherein said motor is an electric motor.

10. A mode-switchable door strike switchable between a fail safe mode and a fail secure mode, comprising:

a) a housing having an opening for admission and retraction of a door bolt;

b) a keeper arm movably attached to said housing, and movable between a closed position wherein said opening is occluded and an open position wherein said door bolt may be released from said opening;

c) a transmission lever pivotably attached to said housing for selectively engaging said keeper arm and being rotatable to selectively lock and unlock said keeper arm in said closed position;

d) an actuator connected to said housing;

e) a release lever rotatably attached to said housing at a first point and engaged with said transmission lever at a second point to selectively lock and unlock said transmission lever by rotating said release lever by said actuator; and f) a stop alternatively mountable in one of at least two positions adjacent said release lever, wherein a first position of said stop limits rotation of said release lever in a first rotational direction when the actuator is de-energized, and wherein a second position of said stop limits rotation of said release lever to a second rotational direction opposite said first rotational direction when the actuator is energized, therefore allowing to switch between said fail safe mode and said fail secure mode;

wherein, the door strike further comprises at least one permanent magnet mounted to said housing for attracting ferromagnetic particles during wear of an element of the door strike during a work life of the door strike.

11. A door strike in accordance with claim 10 wherein said door strike is an electric door strike.

12. A door strike in accordance with claim 10 wherein said at least one permanent magnet is separate from the actuator.

13. A method of mode switching a door strike, the method comprising:

a) providing a mode-switchable door strike switchable between a fail-safe mode and a fail-secure mode, comprising:

i) a housing having an opening for admission and retraction of a door bolt;

ii) a keeper arm movably attached to said housing, and movable between a closed position wherein said opening is occluded and an open position wherein said door bolt may be released from said opening;

iii) an actuator connected to said housing;

iv) a release lever rotatably attached to said housing and operationally connected to said keeper arm to selectively lock and unlock said keeper arm from said closed position by rotation of said release lever by said actuator; and v) a stop alternatively mountable in one of at least two positions adjacent said release lever;

b) selectively positioning said stop in a first position to limit rotation of said release lever in a first rotational direction when said actuator is de-energized; or, alternatively, c) selectively positioning said stop in a second position to limit rotation of said release lever to a second rotational direction opposite said first rotational direction when said actuator is energized, therefore allowing the door strike to switch between said fail-safe mode and said fail secure mode.

14. A method in accordance with claim 13 further comprising the step of providing at least one permanent magnet mounted to said housing for attracting ferromagnetic particles.

15. A method in accordance with claim 13 further including at least one transmission lever pivotably attached to said housing to selectively lock and unlock said keeper arm, wherein said transmission lever is operationally connected to said release lever and to said keeper arm.

* * * * *